US009732519B1

(12) United States Patent
Venturo

(10) Patent No.: US 9,732,519 B1
(45) **Date of Patent: *Aug. 15, 2017**

(54) STACKABLE BUILDING BLOCK WITH VERTICAL CENTER RISERS

(76) Inventor: John J Venturo, Granite Falls, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/824,360

(22) Filed: Jun. 28, 2010

(51) Int. Cl.

| | |
|---|---|
| ***E04B 1/16*** | (2006.01) |
| ***E04B 2/64*** | (2006.01) |
| ***E04B 2/42*** | (2006.01) |
| ***E04B 2/56*** | (2006.01) |

(52) U.S. Cl.
CPC ..... *E04B 2/64* (2013.01); *E04B 2/42* (2013.01); *E04B 2/56* (2013.01)

(58) Field of Classification Search
CPC ..... E04B 2/14; E04B 2/18; E04B 2/42; E04B 2/46; E04B 2/56; E04B 2/58; E04B 2/64
USPC ..... 52/424, 485, 426, 433, 438, 407.1, 561, 52/566, 606, 607
See application file for complete search history.

(56) References Cited

U.S. PATENT DOCUMENTS

| | | | | |
|---|---|---|---|---|
| 1,353,702 | A * | 9/1920 | Aschauer | E04B 2/28 405/273 |
| 4,223,501 | A * | 9/1980 | DeLozier | 52/309.12 |
| 4,640,071 | A * | 2/1987 | Haener | E04B 2/46 52/100 |
| 4,655,014 | A * | 4/1987 | Krecke | 52/105 |
| 4,854,103 | A * | 8/1989 | Klym | 52/592.6 |
| 4,894,969 | A * | 1/1990 | Horobin | 52/309.12 |
| 5,598,675 | A * | 2/1997 | Pruss | 52/309.4 |
| 5,623,797 | A * | 4/1997 | Gravier | E01F 8/0017 256/19 |
| 5,901,520 | A * | 5/1999 | Abdul-Baki | E04B 2/16 52/421 |
| 6,647,686 | B2 * | 11/2003 | Dunn et al. | 52/426 |
| 7,174,687 | B2 * | 2/2007 | Ferguson | E04B 2/52 52/100 |
| 2002/0000071 | A1 * | 1/2002 | Al-Ghitta | 52/426 |
| 2002/0007610 | A1 * | 1/2002 | Abang Ali | E04B 2/44 52/604 |
| 2005/0204663 | A1 * | 9/2005 | Ferguson | E04B 2/52 52/270 |

* cited by examiner

*Primary Examiner* — William Gilbert
(74) *Attorney, Agent, or Firm* — Joseph Z. Ellsworth

(57) ABSTRACT

A building block has opposing like outer members spaced apart by at least two risers as cross members inward from outer member ends leaving a center open with a void between the outer members and the risers. The risers extend from the bottom of the block to above the outer member tops. A continuous tongue projects upward from the top of the outer members parallel thereto along the length of the outer member and mates with grooves along the bottom of a similar outer member stackable thereon for ease of block alignment. A next stacked block is nailed to the risers projecting into its center.

20 Claims, 5 Drawing Sheets

STACKABLE BUILDING BLOCK WITH VERTICAL CENTER RISERS

BACKGROUND

Field of the Invention

This invention relates to blocks for easy construction of a building, and more specifically to a building block with risers extending upward from intermediate the block into a like next vertically adjacent stacked block.

Prior Art

It is known to have blocks suitable for constructing a building. Representative of such building blocks are the following patents.

Disclosed in a patent with patent number JP05079104A issued in Japan is a building block that has a channel on top and bottom. A slat fits in a groove of a first block and extends above the block to receive a bottom channel of a next block stacked on the first block. The slat thus connects the two blocks together.

Disclosed in a patent with patent number JP2002356941A issued in Japan is a building block that has a groove central on all sides of the block.

Disclosed in a patent with patent number JP2007278046A issued in Japan is a building block that comprises two opposed face members with a plurality of opposing grooves on respective inner block sides. A slat fits in each groove between the face members joining the face members. The slats extend from a distance from the bottoms of the face members to above the face members the same distance to be received into similar grooves of a next block stacked thereon. The slats are maintained in position by nails or screws through the face members into the slats.

Disclosed in a patent with U.S. Pat. No. 4,956,958 issued in the United States is a building block that has dihedral projections on an end of tops of opposing face members which mate with dihedral recessions on the opposite end of the bottom of a similar block stacked thereon so stacked blocks overlap. A cross member extends between the opposing face members also with dihedral projections. The top of the face members except for the dihedral projections are slanted or have a dihedral projection parallel with the top that mates with dihedral recessions on its bottom at an opposite end. A second cross member extends between the opposing face members and may also have dihedral projections. All of dihedral projections extend a same distance across the top of the block.

Disclosed in a patent with U.S. Pat. No. 6,665,994B1 (also found in WO03104580A1) issued in the United States is a building block that has opposing face members and a cross member at each end with a third cross member central in the block between the face members. Each cross member has a recess on its top and like projections on its bottom that extend further than the depth of the recess so a first block stacks on a second block leaving a channel between the top of the second block and the bottom of the first block. The central cross member is twice the width of end cross members so blocks overlap with end of the first block stacking on the central cross member of the second block.

Disclosed in a patent with patent number US20100043335A1 is a building block that has opposing face members and a cross member at each end with a third cross member central in the block between the face members. Each cross member has a recess on its top and like projections on its bottom to mate with the top of a next stacked block. The center cross member has twice the width of the end cross members so an end s of next stack blocks mate in abutment with the central cross member.

The object of the present invention is to provide a building block with an open or void center between outer members and risers inward from block ends extending above the top of the outer members and receivable into a center of a similar block stackable thereon as a joining member. It is a further object that the outer members be self aligning as they are mutually stacked.

SUMMARY

These objects are achieved in a building block that has opposing like outer members spaced apart by at least two risers as cross members inward from outer member ends leaving a center open with a void between the outer members and risers. The risers extend from the bottom of the block to above the outer member tops requiring a next stacked second block to be stacked in offset from the first block by at least the width of the risers as the risers of the first block extend into the center void of the second block preventing a seam on seam joint between vertically adjacent blocks of a same length when the risers are similarly located within respective blocks. The outer members are spaced apart by the risers a distance of 3¼", equal to the width of cripple, or an end member comprising 2 face to face 2×4 studs, receivable into the open center within the block at the ends of stacked blocks to close the stacked blocks such as for a door or window. The vertical cripple in the end of the wall of stacked blocks is then suitable to support a header. A continuous tongue projects upward from the top of the outer members central in the top and parallel to the outer members along the length of the respective outer members and mates with grooves along the bottom of similar respective outer members for ease of block alignment. The groove is larger than the tongue for ease of assembly leaving approximately 1/16" between each side of the tongue and the groove in which it is received. Nails or screws as fasteners attach the outer members to the risers forming the block. The risers pass from the bottom to the top of the outer members to receive fasteners, such as nails or screws, through the outer members and into the risers. Thus, a next stacked block is nailed to the risers of the block on which it is stacked, obviating the need for vertical pinning between stacked blocks. The blocks are pre-made and then easily and quickly stacked for facile construction of a wall. Each joint between abutting block ends requires a post to seal the joint. Blocks are constructed in standard block lengths of 3', 4', 5', 6', 7' and 8' for ease of construction of light weight blocks.

DETAILED DESCRIPTION OF THE PREFERRED EMBODIMENT

Figure 1:
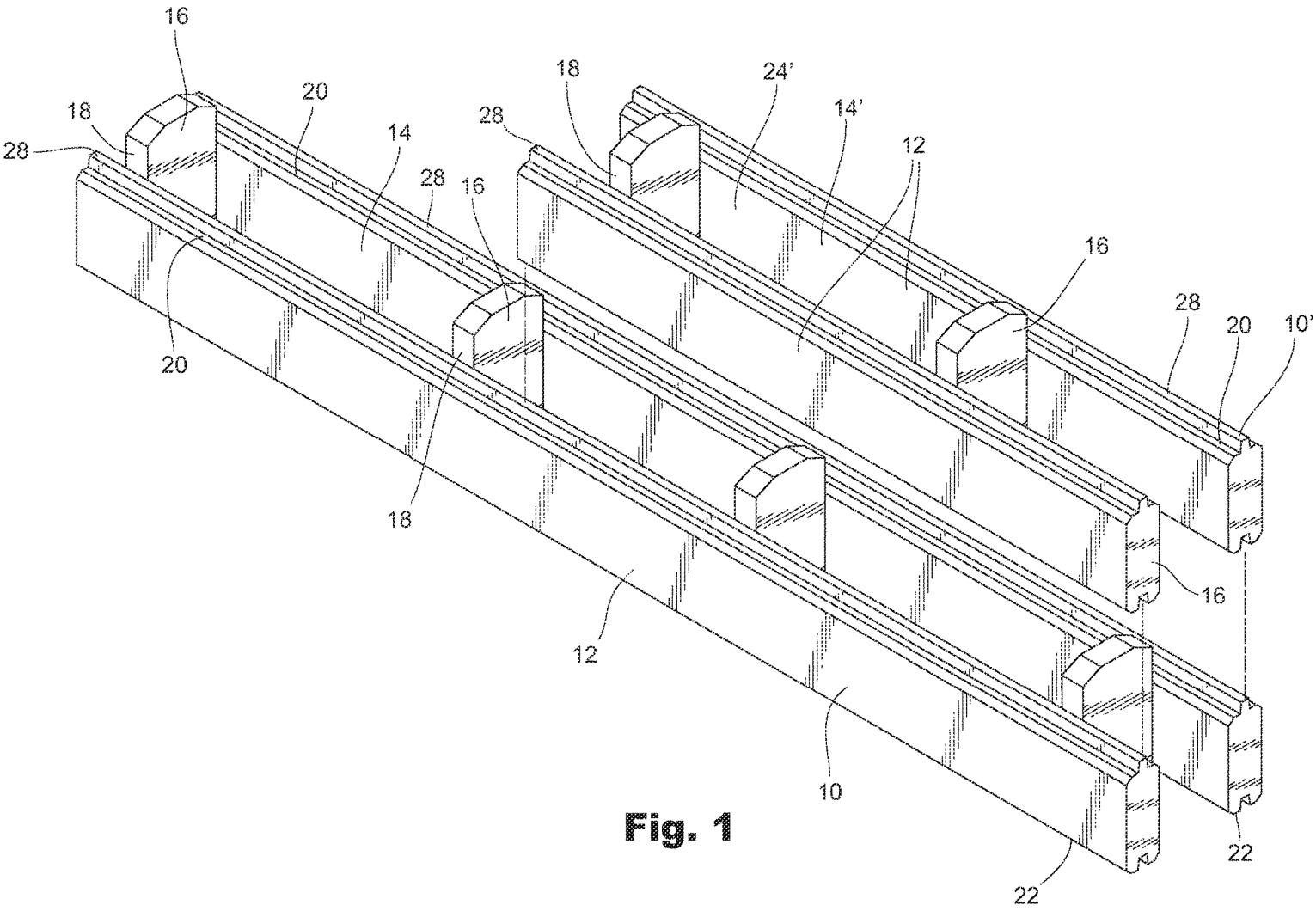
FIG. 1 is a perspective view of a block of the present invention aligned for stacking on a similar second block.
Figure 2:
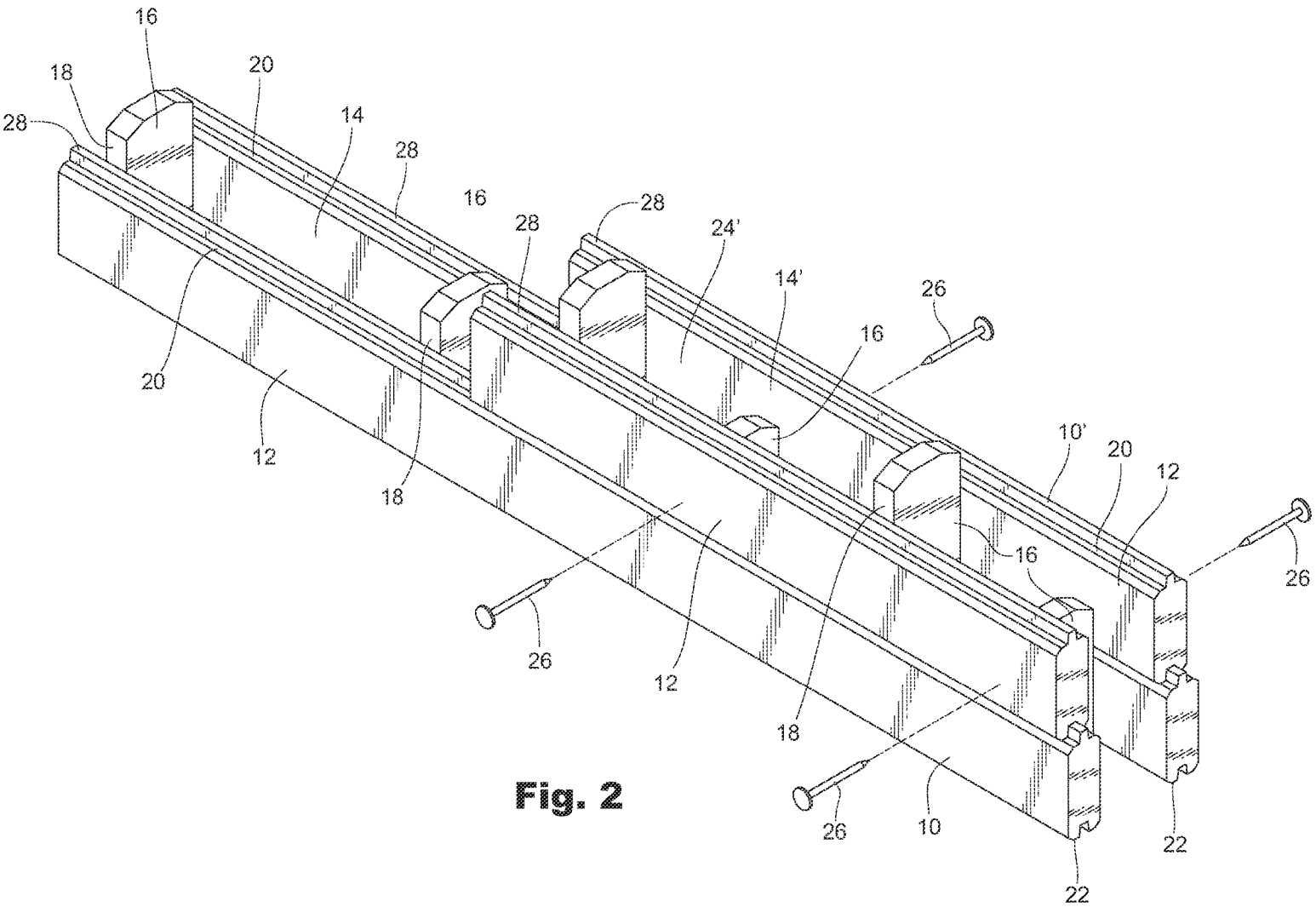
FIG. 2 is a perspective view of the blocks of FIG. 1 stacked together.
Figure 3:
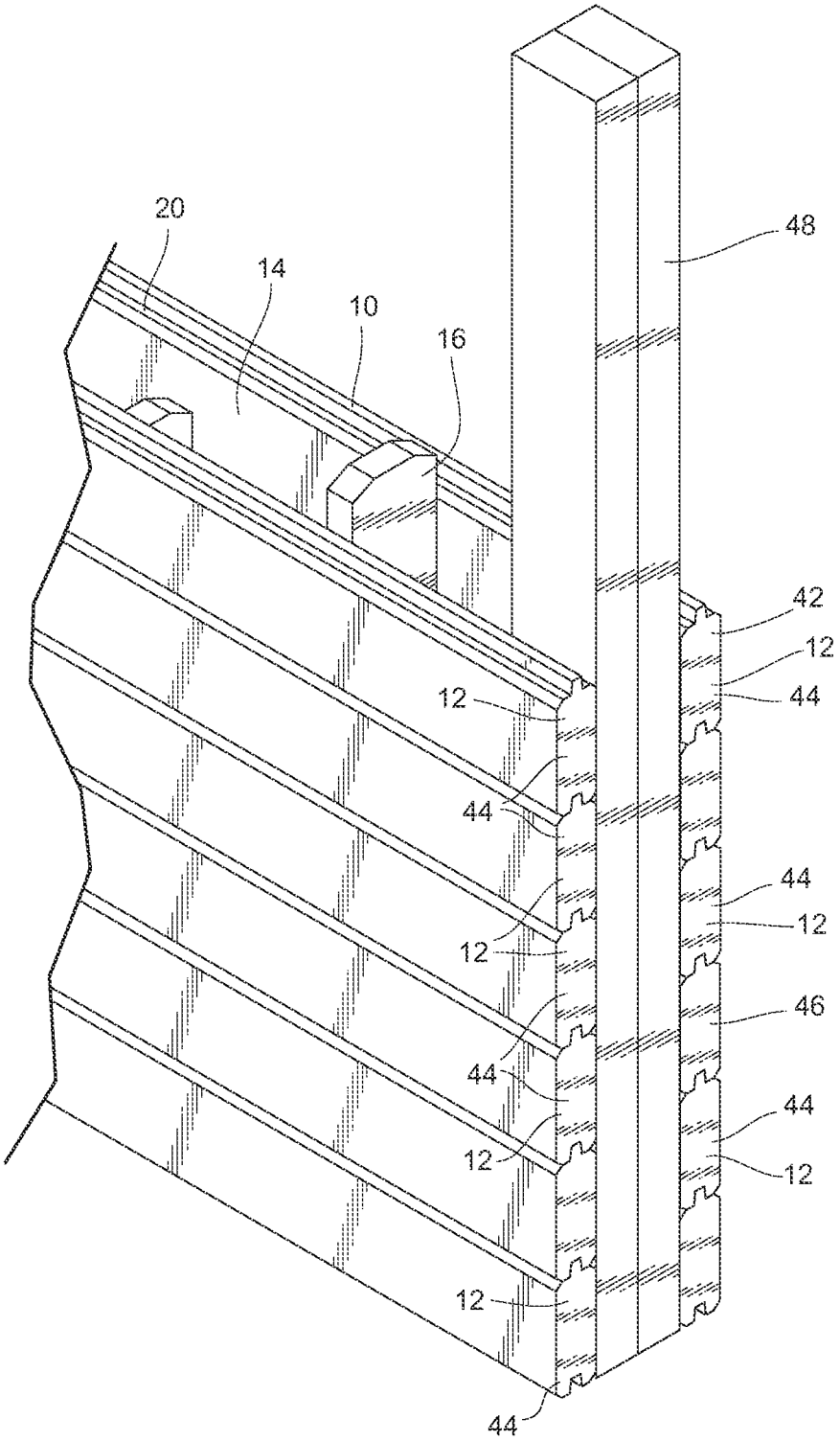
FIG. 3 is a perspective view of a stack of blocks of the invention forming a partial wall together with a vertical end post within the ends of the blocks.
Figure 4:
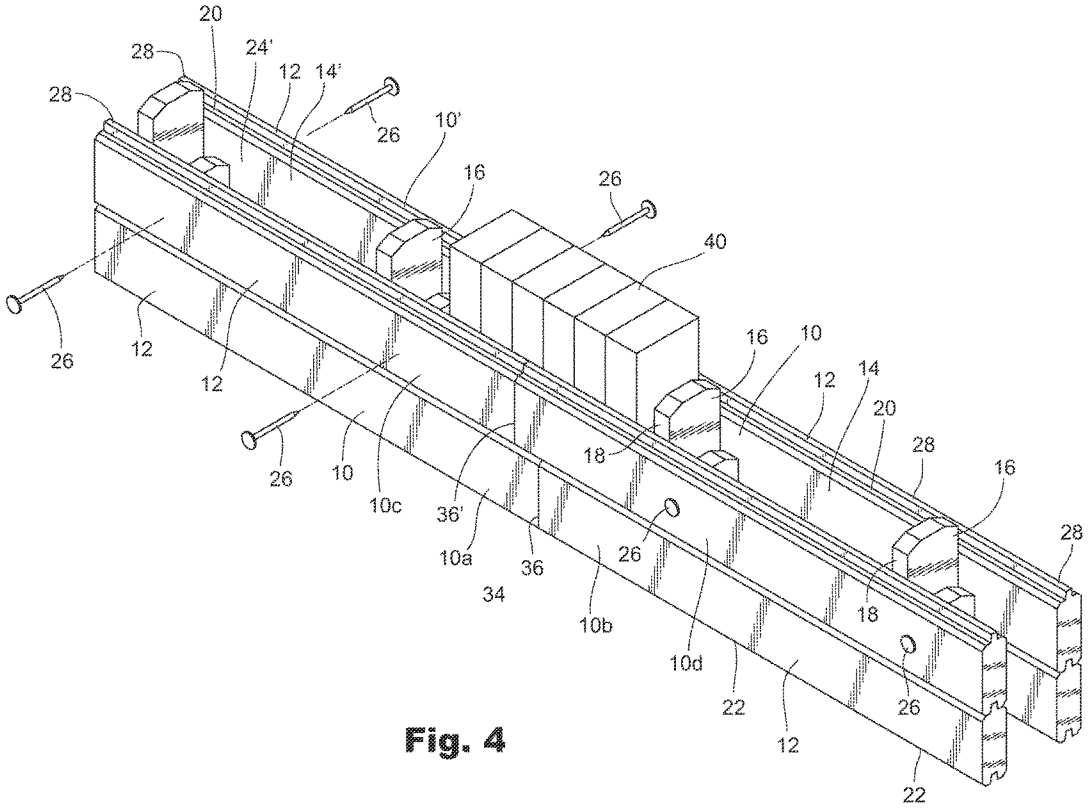
FIG. 4 is a perspective view showing two horizontally adjacent abutting blocks forming a first seam stacked on two horizontally adjacent abutting blocks forming a seam offset from the other seam with a seam post within the blocks with both seams intermediate the width of the seam post.
Figure 5:
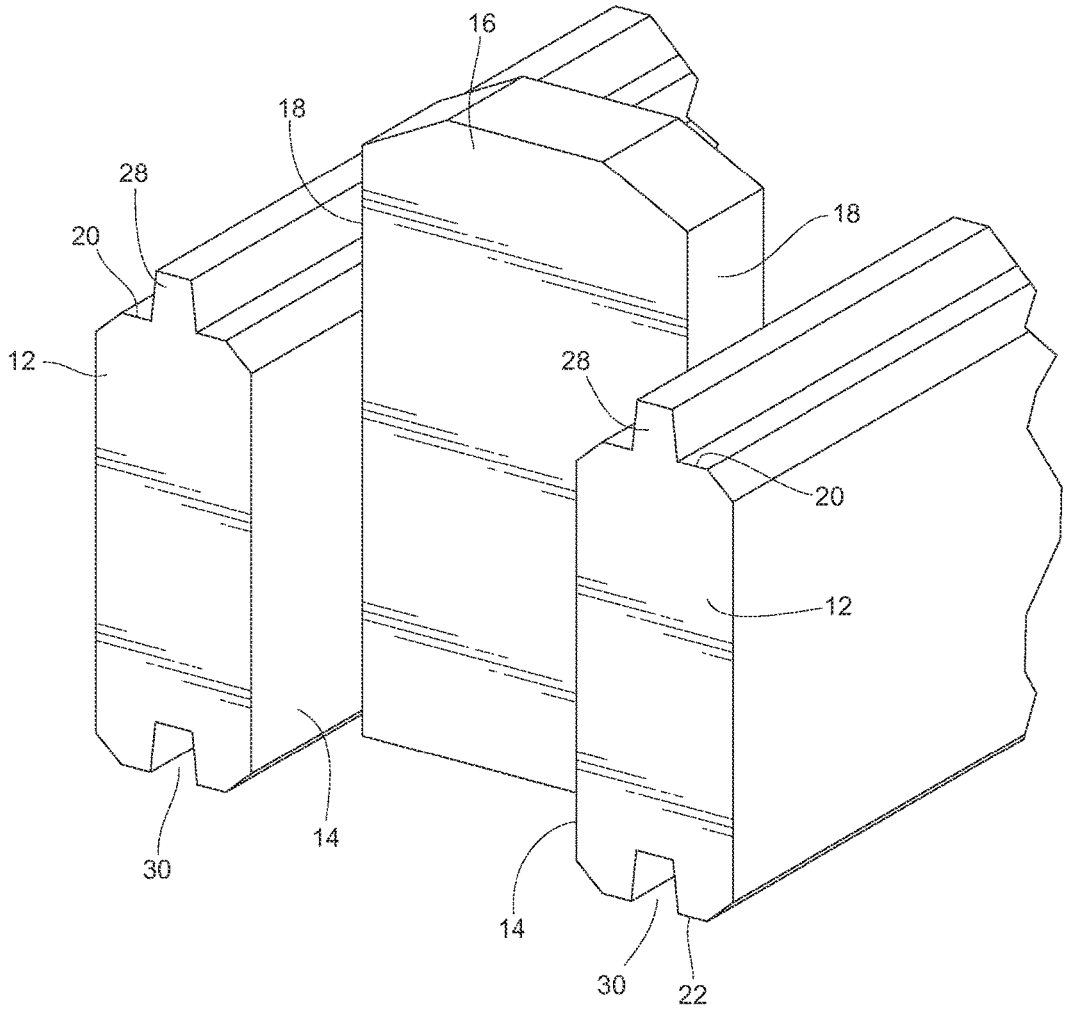
FIG. 5 is an end perspective view of the block of the present invention.

The block 10 for wall construction of the present invention comprises a pair of outer members 12 with flat inner surfaces 14 spaced apart by and in flat face to face contact with at least two risers 16 spaced apart between outer members 12, the risers 16 also having vertical flat surfaces 18 matching the inner surfaces 14 of the outer members 12. The construction results in the block 10 open at its top 20 and bottom 22 and with a void center 24 between outer members 12 and risers 16. The risers 16 extend from the bottom 22 of the block 10 vertically to a height substantially above the outer members 12 with its flat surfaces 18 also continuing beyond the top 20 of the outer members 12, adapted to slidably receive a similar second block 10' stackable thereon and over the extended risers 16 with the extended risers 16 extending into the center 24' of the second block 10'. With the vertically extending risers 16 extending into the center 24' of the second block 10', the riser flat surfaces 18 extending above the block 10 are also in face to face contact with inner surfaces 14' of the outer members 12 of the second block 10' when stacked thereon, connecting the two vertically stacked blocks 10, 10'. A nail 26 is then driven through the outer members 12 of the stacked block 10' into the risers 16 of the block 10 on which it is stacked thus permanently connecting the two blocks 10, 10' together. Clearly, a screw may substitute for the nail, both as fasteners connecting the blocks. The block 10 further comprises a tongue 28 extending upward on the top 20 of at least one outer member 12 longitudinally therewith and a groove 30 on the bottom 22 of the at least one outer member 12 into which the tongue 28 of a similar outer member 12' may be received. The groove 30 is typically slightly larger in width than the tongue 28 for ease of assembly.

Typically in stacking the blocks 10 for a wall construction, blocks 10 are stacked such that ends 34 of horizontally adjacent blocks 10*a*, 10*b* abutting internal the wall forming a seam 36 are offset with next vertically stacked blocks 10*c*, 10*d* likewise forming a seam 36' to avoid a vertical seam on seam joint between stacked blocks at abutting block ends 34. A seam post 40 is insertable vertically between pairs of horizontally adjacent blocks 10*a*, 10*b*. The seams 36 of vertically adjacent blocks 10, 10' are assembled such that the seams 36 lie intermediate the post 40 such that the post 40 closes the seams 36.

A plurality of blocks 10 are stackable forming a wall 42 with open block ends 44 at a wall end 46. An end post 48 is provided insertable in ends 44 of stacked blocks at the wall end 46 closing the block ends 44, suitable for interfacing with a window or a door. The end post 48 also is suitable to support a header for the window or door.

The invention claimed is:

1. A plurality of blocks forming a wall comprising, a first block comprising, a pair of outer members spaced apart by at least two risers, having a first and a second face, inward from outer member ends forming void center between outer members and risers with the block open at its top and bottom with the risers extending vertically substantially above the outer members, the outer members having vertical flat inner surfaces in face to face contact with vertical flat riser surfaces that extend with the risers extending above the outer members, a similar second block slidably receives the risers of the first block wherein the first face of at least one riser of the first block at least partially overlaps the second face of at least one riser of the second block as the risers extend into a center of the second block wherein, the risers extend from the bottom of the block to beyond and above the outer member tops, and wherein, the second said block is stacked vertically adjacent on the first said block and the risers of the first said block extend into the center of the second said block offset from the risers of the first said block further comprising a substantially horizontal fastener through said second block and into said risers that are received therein thereby connecting the blocks together.

2. The block of claim 1 wherein the fastener is a nail or screw.

3. The block of claim 1 further comprising a tongue extending upward on the top of at least one outer member longitudinally therewith and a groove on the bottom of the bottom of the at least one outer member into which the tongue of a similar outer member may be received.

4. The block of claim 3 in which the groove is slightly larger in width than that of the tongue for ease of assembly.

5. The block of claim 1 wherein a plurality of blocks are vertically stackable forming a wall wherein abutting ends of horizontally adjacent blocks internal the wall are offset with ends of similar horizontally adjacent blocks stacked thereon therein preventing a seam on seam joint at block ends.

6. The block of claim 5 further comprising a seam post insertable vertically at said seams with said seams intermediate the post such that the post closes the seams.

7. The block of claim 1 further comprising a plurality of said blocks stackable to form a wall with open block ends at a wall end and a vertical end post insertable into ends of the blocks a wall end therein closing the blocks.

8. A wall comprising, a first block comprising, a pair of outer members spaced apart by at least two risers having a first and a second face, inward from outer member ends forming void center between outer members and risers with the block open at its top and bottom with the risers extending vertically substantially above the outer members, the outer members having vertical flat inner surfaces in face to face contact with vertical flat riser surfaces that extend with the risers extending above the outer members, adapted to slidably receive the risers of the second block wherein the first face of at least one riser of the second block at least partially overlaps the first face of at least one riser of the first block wherein, the second said block when stacked vertically adjacent on the first said block receives the risers of the first said block extending into the center of the second said block offset from the risers of the first said block and, further comprising a tongue extending upward on the top of at least one outer member longitudinally therewith and a groove on the bottom of the bottom of the at least one outer member into which the tongue of a similar outer member may be received and wherein, the risers extend from the bottom of the block to beyond and above the outer member tops, further comprising a substantially horizontal fastener through said blocks and into said risers that are received therein from the next adjacent stacked block thereby connecting the block with the next adjacent block.

9. The block of claim 8 wherein a plurality of blocks are vertically stackable forming a wall wherein abutting ends of horizontally adjacent blocks internal the wall are offset with ends of similar horizontally adjacent blocks stacked thereon therein preventing a seam on seam joint at block ends.

10. The block of claim 9 further comprising a seam post insertable vertically at said seams with said seams intermediate the post such that the post closes the seams.

11. The block of claim 8 further comprising a plurality of said blocks stackable to form a wall with open block ends at a wall end and a vertical end post insertable into ends of the blocks a wall end therein closing the blocks.

12. A block for wall construction, comprising a pair of outer members spaced apart by at least two risers inward from outer member ends forming void center between outer members and risers with the block open at its top and bottom with the risers extending from the bottom of the block vertically substantially above the outer members, the outer members having vertical flat inner surfaces in face to face contact with vertical flat riser surfaces that extend with the risers extending above the outer members, adapted to slidably receive a similar second block in face to face contact with inner surfaces of the second block as the risers extend into a center of the second block and further comprising a tongue extending upward on the top of at least one outer member longitudinally therewith and a groove on the bottom of the bottom of the at least one outer member into which the tongue of a similar outer member may be received, wherein a plurality of blocks are vertically stackable forming a wall wherein abutting ends of horizontally adjacent blocks internal the wall are offset with ends of similar horizontally adjacent blocks stacked thereon therein preventing a seam on seam joint at block ends, a seam post insertable vertically at said seams with said seams intermediate the seam post such that the seam post closes the seams.

13. The block of claim 12 further comprising a vertical end post insertable into open ends of the blocks at a wall end therein closing the blocks to create the vertical surface to interface with a door or window.

14. The block of claim 12 further comprising a plurality of seam posts insertable vertically into the void center to create a horizontal surface as a header over a door or window.

15. A plurality of blocks forming a wall comprising, a first block comprising, a pair of outer members spaced apart by at least two risers, having a first and a second face, inward from outer member ends forming void center between outer members and risers with the block open at its top and bottom with the risers extending vertically substantially above the outer members, the outer members having vertical flat inner surfaces in face to face contact with vertical flat riser surfaces that extend with the risers extending above the outer members, a similar second block slidably receives the risers of the first block wherein the first face of at least one riser of the first block at least partially overlaps the second face of at least one riser of the second block as the risers extend into a center of the second block wherein, the risers extend from the bottom of the block to beyond and above the outer member tops, and wherein, the second said block is stacked vertically adjacent on the first said block and the risers of the first said block extend into the center of the second said block offset from the risers of the first said block, further comprising a seam post insertable vertically at said seams with said seams intermediate the post such that the post closes the seams.

16. The block of claim 15 wherein the fastener is a nail or screw.

17. The block of claim 15 further comprising a tongue extending upward on the top of at least one outer member longitudinally therewith and a groove on the bottom of the bottom of the at least one outer member into which the tongue of a similar outer member may be received.

18. The block of claim 17 in which the groove is slightly larger in width than that of the tongue for ease of assembly.

19. The block of claim 15 wherein a plurality of blocks are vertically stackable forming a wall wherein abutting ends of horizontally adjacent blocks internal the wall are offset with ends of similar horizontally adjacent blocks stacked thereon therein preventing a seam on seam joint at block ends.

20. The block of claim 15 further comprising a plurality of said blocks stackable to form a wall with open block ends at a wall end and a vertical end post insertable into ends of the blocks, a wall end therein closing the blocks.

* * * * *